US006895706B2

(12) United States Patent
Schottlander

(10) Patent No.: US 6,895,706 B2
(45) Date of Patent: May 24, 2005

(54) DISPLAY DEVICE

(75) Inventor: Mark Schottlander, London (GB)

(73) Assignee: Bay Media Limited, London (GB)

( * ) Notice: Subject to any disclaimer, the term of this patent is extended or adjusted under 35 U.S.C. 154(b) by 1 day.

(21) Appl. No.: 10/191,569

(22) Filed: Jul. 8, 2002

(65) Prior Publication Data

US 2003/0079390 A1 May 1, 2003

(30) Foreign Application Priority Data

Oct. 29, 2001 (GB) ..... 0125872

(51) Int. Cl.[7] ..... G09F 3/18
(52) U.S. Cl. ..... 40/642.02; 40/600
(58) Field of Search ..... 40/642.02, 600, 40/592, 591, 124.19, 124.15, 506, 661.08, 610, 124.14

(56) References Cited

U.S. PATENT DOCUMENTS 1,685,571 A * 9/1928 Meller ..... 40/124.14
2,881,662 A * 4/1959 Harris ..... 40/124.15 X
3,471,958 A * 10/1969 Westin ..... 40/592
4,541,190 A * 9/1985 Weiner et al. ..... 40/124.15 X
5,010,669 A * 4/1991 Moran ..... 40/124.15 X
5,157,852 A * 10/1992 Patrou et al. ..... 40/124.19 X
5,358,762 A * 10/1994 McGrath ..... 428/12
5,613,311 A * 3/1997 Burtch ..... 40/124.15
5,711,100 A * 1/1998 Elmer ..... 40/592
5,933,994 A * 8/1999 Misaresh ..... 40/649

* cited by examiner

*Primary Examiner*—Joanne Silbermann
(74) *Attorney, Agent, or Firm*—Smith-Hill and Bedell

(57) ABSTRACT

A display device is described for use as a checkout counter divider. The device comprises a flat blank 10 and an elongate weight 40. The blank has fold lines to permit it to be folded onto itself to form an elongate hollow bar having a base and at least two further sides 12 and 14. The elongate weight is secured in use to the base of the hollow bar, to add stability to the hollow bar when resting on its base.

4 Claims, 4 Drawing Sheets

DISPLAY DEVICE

Figure 1:
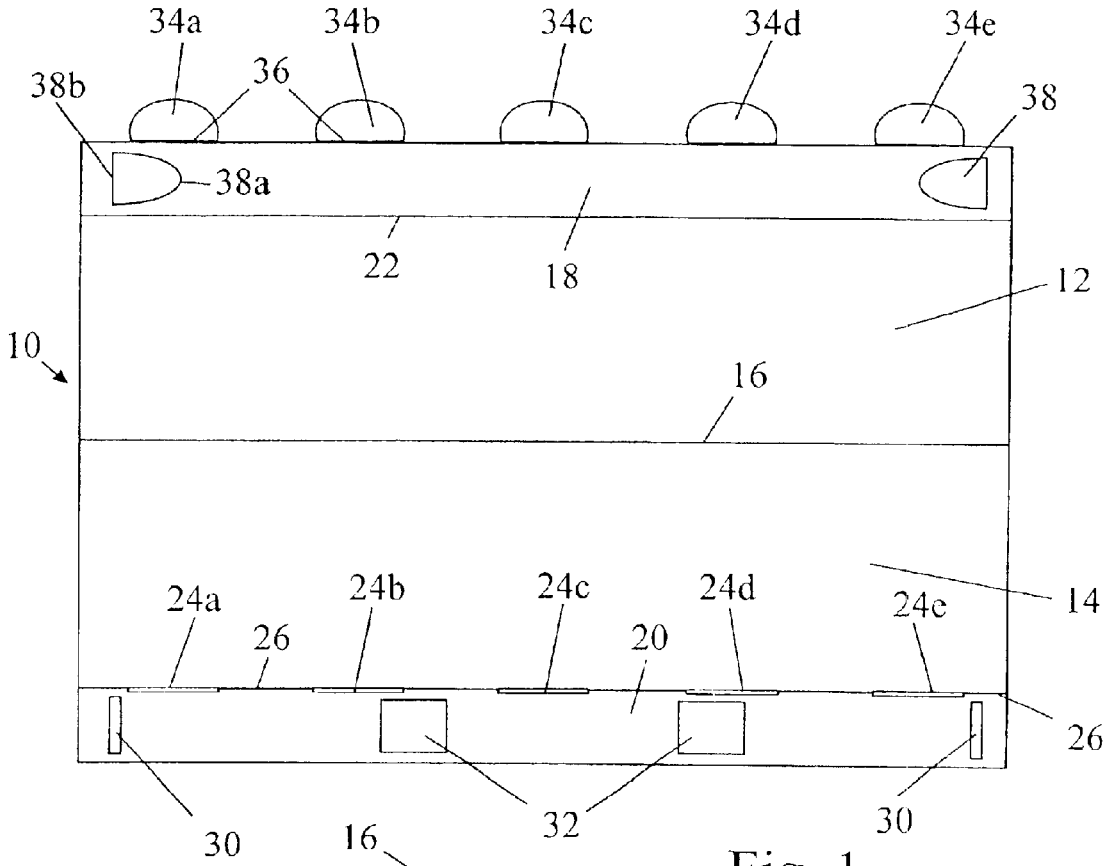

The present invention relates to a display device that is intended for example to act as a checkout counter divider to separate between the shopping of different customers on the conveyor at a checkout in a store.

It is common to use checkout counter dividers as described above to act as a demarcation between the goods of different customers in a store. The dividers are normally solid bars about 2.5 cms (1 inch) wide that are stored in a slightly wider channel or on a ridge extending parallel to the conveyor. Because they are subjected to considerable wear, such dividers are often unattractive.

The present invention in its broadest aspect provides a display device for use as a checkout counter divider, the device comprising a flat blank and an elongate weight, wherein the blank has fold lines to permit the blank to be folded onto itself and its opposite edges to be fastened to one another to form a self-supporting elongate hollow bar having a base and at least two further sides and wherein the elongate weight is secured in use to the base of the hollow bar, to add stability to the hollow bar when resting on its base.

Preferably, the hollow bar has a triangular cross-section, the triangle having sides of unequal length and the height of the triangle being significantly greater than the width of its base. The narrow base permits the divider to be stored in the channel or on the ridge normally provided for this purpose and to this end it is preferred that the width of the base of the divider should be about 2.5 cms. The larger upright sides, on the other hand, provide suitable surfaces for displaying point of sale information, which may for example be printed on the blanks.

As a conventional checkout counter divider is also required to interrupt a light beam that controls the movement of the conveyor at the checkout counter, it is preferred to provide a tab as part of the blank to be bent out of one or both of the sides, preferably the base, of the device in order to obstruct the passage of light down the hollow centre of the assembled device.

It is preferred to form the elongate weight as a metal plate having a width comparable with the width of the base, in which case the tabs that obstruct the light beam may act additionally as a means for retaining the plate captive in the device when the blank is folded.

The blank, which is conveniently made of a sheet material, for example, polypropylene or a plastics coated board, may suitably comprise four longitudinally extending sections separated from one another by parallel fold lines, there being two wider sections for forming two sides of the bar and two narrower sections to overlie one another and form the base of the hollow bar.

In order to retain the blank in the folded condition, one of the narrower sections may have projecting tongues to engage in slits in the blank. Forming the tongues with an undercut at their base, prevents the blanks from being unfolded after assembly.

If it is desired to increase the area on which display information can be printed, it is possible to provide on the blank a flap that is attached by means of a fold line to the narrower section having the projecting tongues, the flap passing through two slits formed in the blank, such that the flap projects upwards in the folded condition of the checkout counter divider.

The display device of the invention is not restricted to use as a checkout divider and it may instead to be used as a receptacle to hold leaflets or tickets. In such an embodiment of the invention, it is possible to provide, a finger that is cut out of the one of the upright sides of the bar and bent into the interior of the hollow bar into contact with the opposite upright side, the hollow bar may then also have an opening through which a stack of leaflets may be inserted into the device, the bent finger acting as a spring to grip the leaflets. The leaflets could carry advertising material or they may for example be blank lottery tickets.

Though it is possible to print the display information directly on to the blank, it is alternatively possible to provide a transparent cover having projecting tongues to engage in slits in the hollow bar to permit the cover to be fitted to and to overlie one or both of the sides of the hollow bar. In this case, a paper sheet carrying display information may be sandwiched between the side of the device and the overlying transparent cover. The sheet can be removed and replaced as required, the transparent protective cover acting as a viewing window that protects the sheet from soiling.

Figure 2:
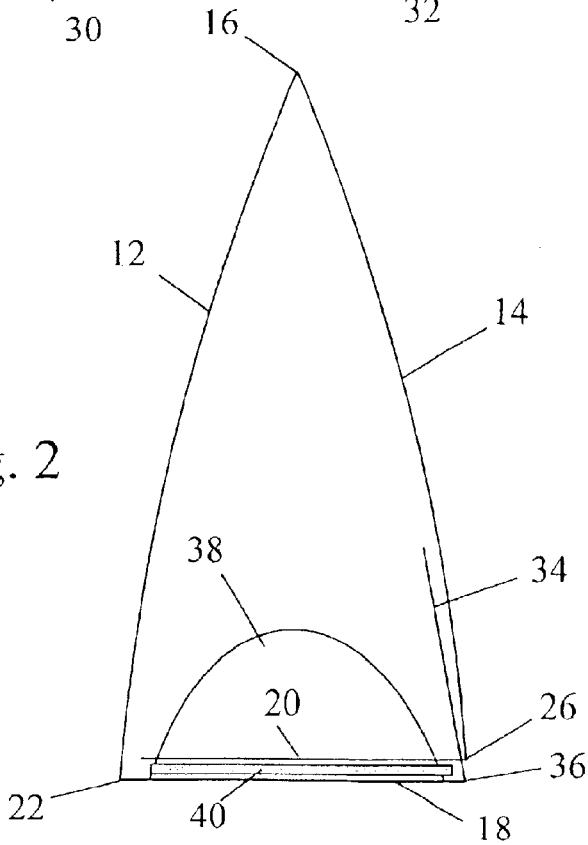
Figure 4:
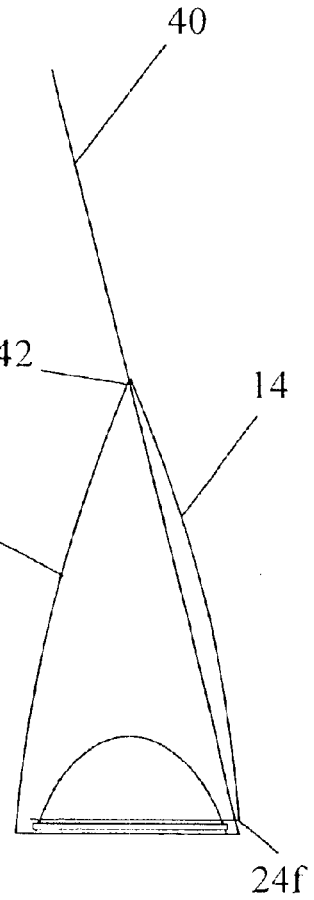
Figure 3:
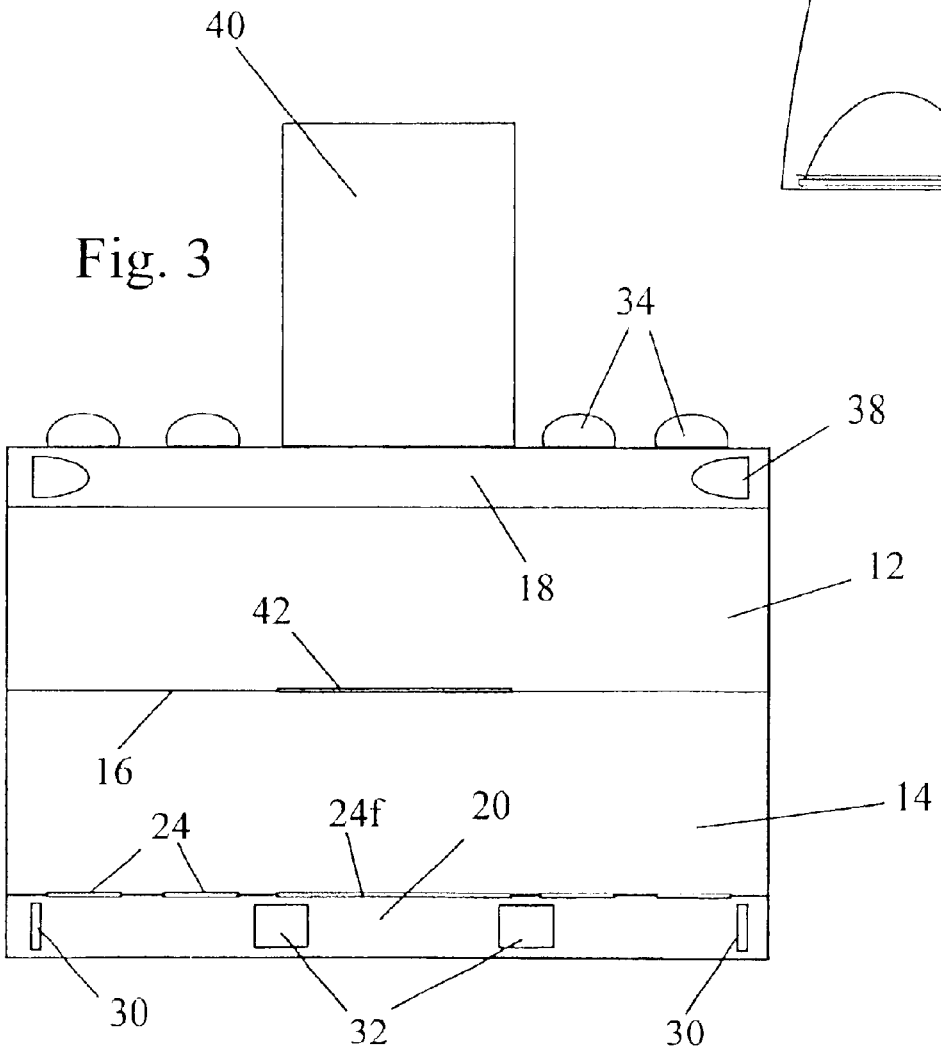
Figure 5:
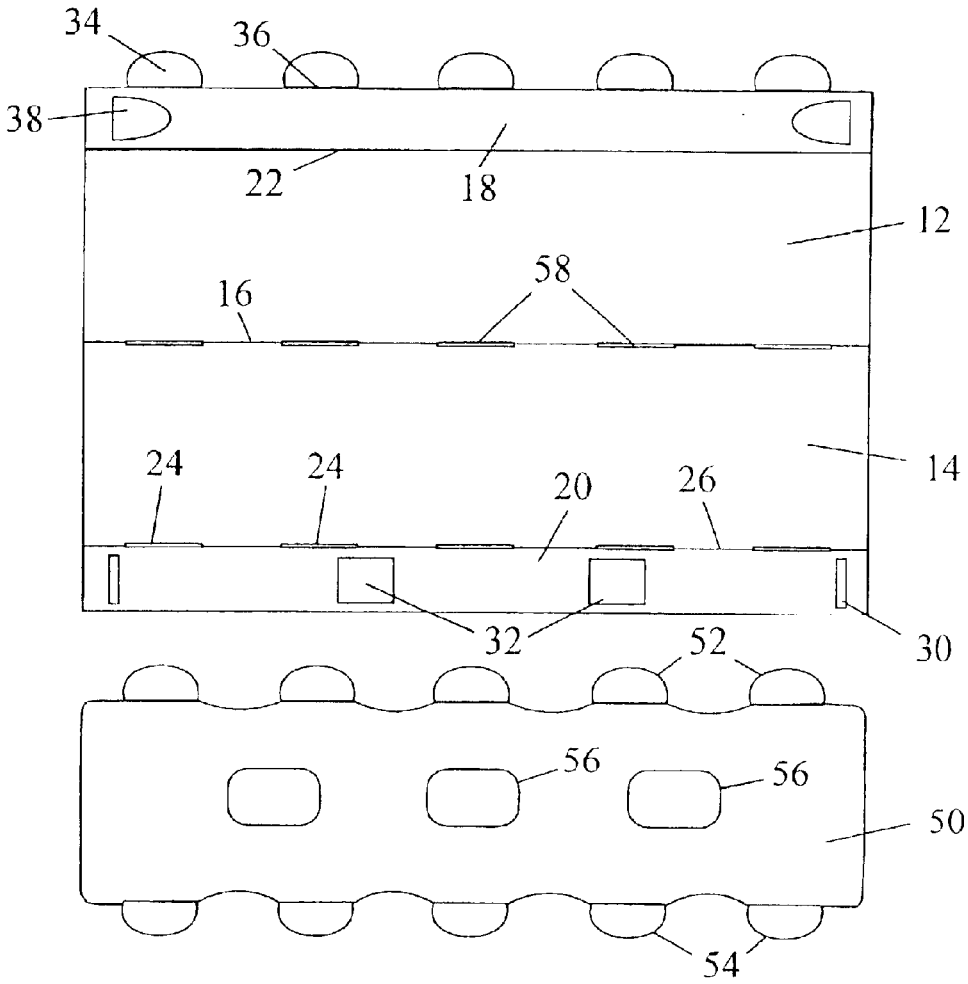
Figure 6:
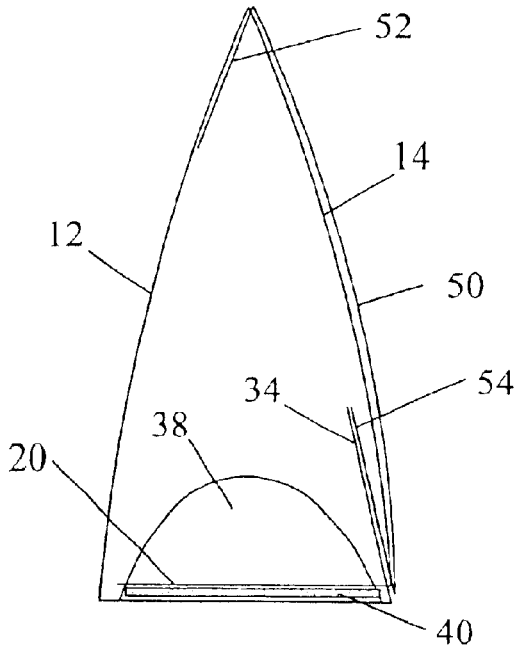
Figure 7:
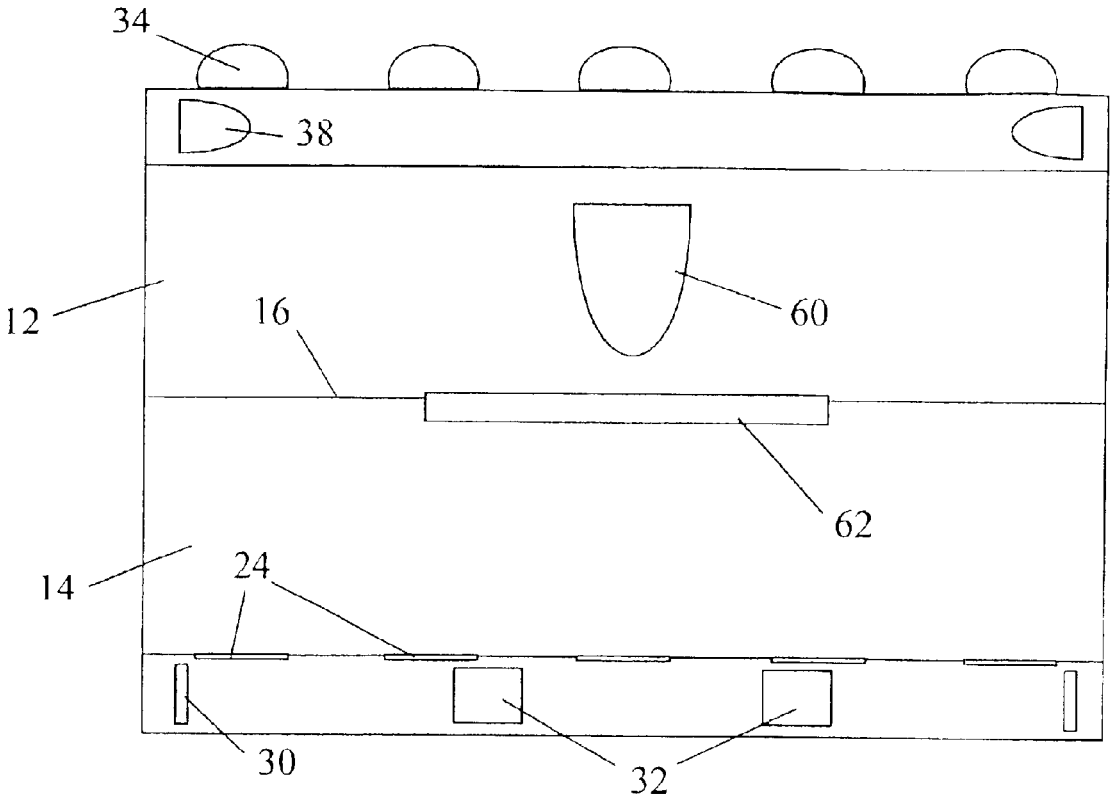
Figure 8:
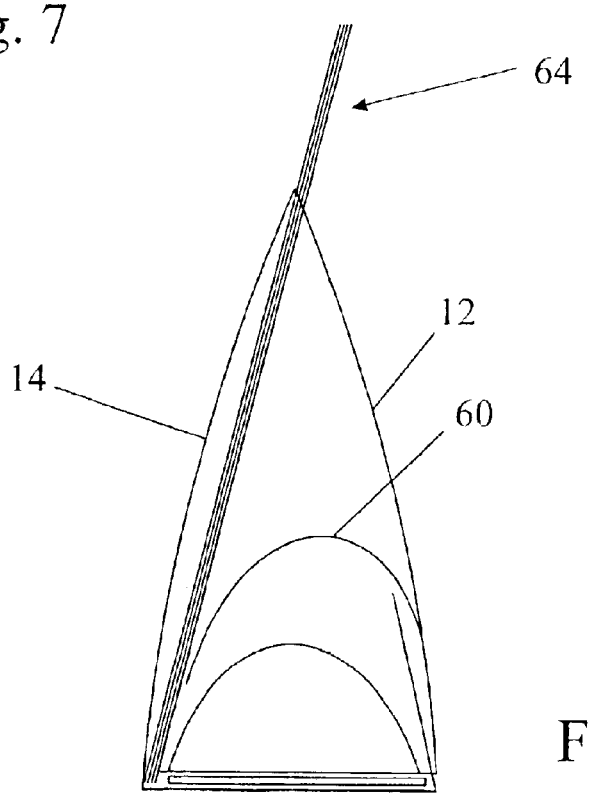

The invention will now be described further, by way of example, with reference to the accompanying drawings, in which:

FIG. 1 shows a plan view of a blank for forming a separator bar in accordance with a first embodiment of the invention, FIG. 2 shows a section through a checkout counter divider formed by following a blank as shown in FIG. 1, FIGS. 3 and 4 are view similar to FIGS. 1 and 2, respectively, showing an alternative embodiment of the invention, FIGS. 5 and 6 are view similar to FIGS. 1 and 2, respectively, showing a further embodiment of the invention, and FIGS. 7 and 8 are view similar to FIGS. 1 and 2, respectively, showing a still further embodiment of the invention.

FIG. 1 shows a printed blank 10 that is formed of sheet polypropylene or other suitable material. The blank is pre-formed with various fold lines, slits and slots as will now be described to enable it to be folded into an elongate hollow bar having the cross section shown in FIG. 2.

The blank 10 comprises two wider sections 12 and 14 separated from another by a fold line 16. The blank further includes two narrower sections 18 and 20 that extend parallel to the wider sections 12 and 14. A first of the narrower sections 18 is connected to a first of the wider sections 12 by a fold line 22 while the second narrower section 20 is connected to the section wider section 14 by a fold line 26, the latter fold line being interrupted by five slits 24, which in FIG. 1 are individually designated 24*a* to 24*e*. The slits 24 have been shown as very narrow cut outs so that they may be distinguished from the fold line 26 which are formed by creasing, weakening or scoring the sheet material. In practice, the slits 24 need not involve the removal of material from the blank and they need only be cuts that penetrate the full thickness of the sheet material.

The first narrower section 18 has five projecting tongues 34 (again labelled individually 34*a* to 34*e* in FIG. 1) each connected to the outer edge of the section 18 by a hinge line 36. Arcuate slits 38*a* formed near the ends of the first section define tabs 38 that can be bent about hinge lines 38*b* to lie out of the plane of the section 18.

The second narrower section 20, on the other hand, is formed with two slots 30 (these perform better with material removal) near its ends and two wider apertures 32 along its length through which a metal plate 40 (see FIG. 2) as wide as these apertures can be threaded to act as a weight.

To assemble a checkout counter divider from the blank 10, a metal plate 40 is first threaded through the apertures 32 so that its ends lie to one side of the blank and its mid-region lies on the other side.

The next steps is to fold the tabs 38 out of the plane of the narrower section 18 and then fold the blank about the hinge lines 16, 22 and 26 to form a triangle. At the end of the folding movement, the tabs 38 are introduced into the slots 30 and the tongues 34*a* to 34*e* are inserted into the slits 24*a* to 24*e* respectively. With the blank folded in this manner, the plate 40 is held captive and cannot be removed from the hollow bar. Because of the illustrated undercutting of the tongues 34 near their base, they cannot be easily retracted from the slits 34 once the checkout counter dividers have been assemble.

In this folded or assembled form as shown in FIG. 2, the tabs 38 stand up from the section 18 and are maintained upright by the slots 30. Hence, these tabs act as an obstruction to prevent a light beam from passing through the hollow centre of the checkout counter divider. In this way, the bar will be readily detected by the sensor used to control the movement of a conveyor in a store. The tab also acts as a barrier to prevent the metal plate 40 that is used as a weight from sliding out of the end of the checkout counter divider.

The embodiment of FIGS. 1 and 2 therefore can be seen to provide an inexpensive device that presents a large surface area on which point of sale material can be attractively displayed. The device is stable because its base is weighted and it can be stored away in the channels that are provided for this purpose along the length of the conveyor.

The remaining embodiments are all generally similar to that of FIGS. 1 and 2 and to avoid unnecessary description parts serving the same or an equivalent function have been allocated the same reference numerals and will not be described again.

The main difference in the embodiment of FIGS. 3 and 4 resides in the fact that one of the tongues 34 has been replaced by a much larger flap 40 which, when the blank is folded is inserted into a slit 24*f* at the base of the triangle and then into a slit 42 in the apex of the triangle to present a further display panel on which point of sale display material can be printed.

The embodiment of FIGS. 5 and 6 differs from that of FIGS. 1 and 2 in that a cover 50 made of a transparent plastics material is provided to be mounted over one or both of the sides 14 of the device. The cover has tongues 54 that engage in the same slits 24 as the tongues 34 and further tongues 52 that engage in slits 58 in the apex of the triangle. A paper sheet carrying display material can be sandwiched between the side 14 of the device and its transparent cover 50 and this sheet may be replaced from time to time for different promotions. Cut outs 56 formed in the cover 50 permit the promotion sheet to be advanced by friction into and out of the display window.

The embodiment of FIGS. 7 and 8 is intended for use as a receptacle for vouchers, lottery tickets or promotional leaflets. A finger 60 is formed by an arcuate slit in one section 12 of the blank. When the blank is folded, as shown in FIG. 8, the finger is bent inwards to contact the opposite section. The finger 60 acts as a spring to grip leaflets 64 that are introduced into the device through a wide aperture 62 formed by a cut out near the apex of the triangle.

It should be clear to the person skilled in the art that various modifications may be made to the described preferred embodiments of the invention without departing from the scope of the invention as set out in the appended claims. For example, the preferred embodiments rely exclusively on mechanical interlocking to hold the blank in its folded condition and to retain the weight within the blank. It would alternatively be possible, for example, to use an adhesive to hold the edges of the blank together after the blank has been folded or to hold the weight against the base of the hollow bar.

What is claimed is:

1. A display device for use as a checkout counter divider, the device comprising a flat blank and an elongate weight, wherein the blank has fold lines to permit the blank to be folded onto itself and its opposite edges to be fastened to one another to form a self-supporting elongate hollow bar having a base and at least two further sides, the elongate weight is formed as a metal plate having a width comparable with the width of the base and is secured in use to the base of the hollow bar to add stability to the hollow bar when resting on its base, a tab is provided as part of the blank to be bent out of one or both of the sides of the device in order to obstruct the passage of light down the hollow centre of the assembled device, and each tab acts additionally as a means for retaining the plate captive in the device when the blank is folded.

2. A device as claimed in claim 1, wherein the hollow bar has a triangular cross-section, the triangle having sides of unequal length and the height of the triangle being significantly greater than the width of its base.

3. A device as claimed in claim 2, wherein the blank comprises four longitudinally extending sections separated from one another by parallel fold lines, there being two wider sections for forming two sides of the bar and two narrower sections to overlie one another and form the base of the hollow bar.

4. A display device for use as a checkout counter divider, the device comprising a flat blank and an elongate weight, wherein the blank has fold lines to permit the blank to be folded onto itself and its opposite edges to be fastened to one another to form a self-supporting elongate hollow bar having a base and at least two further sides, the elongate weight is secured in use to the base of the hollow bar to add stability to the hollow bar when resting on its base, the blank comprises four longitudinally extending sections separated from one another by parallel fold lines, there being two wider sections for forming two sides of the bar and two narrower sections to overlie one another and form the base of the hollow bar, one of the narrower sections has projecting tongues to engage in slits in the blank in order to retain the blank in the folded condition, the tongues have an undercut at their base so as to prevent the blanks from being unfolded after assembly, and the device further comprises an elongate flap that is attached by means of a fold line to the narrower section having the projecting tongues, the flap passing through slits formed in the blank, such that the flap projects upwards in the folded condition of the checkout counter divider to provide a further display panel on which display material may be printed and/or attached.

* * * * *